United States Patent [19]

Ito

[11] Patent Number: 4,784,228

[45] Date of Patent: Nov. 15, 1988

[54] IMPACT DEVICE

[75] Inventor: Ikuo Ito, Nagoya, Japan

[73] Assignee: Teisaku Co., Ltd., Nagoya, Japan

[21] Appl. No.: 94,697

[22] Filed: Sep. 9, 1987

[30] Foreign Application Priority Data

Sep. 9, 1986 [JP] Japan ..... 61-138470

[51] Int. Cl.[4] ..... B25D 9/18

[52] U.S. Cl. ..... 173/134; 91/290; 91/300; 91/321

[58] Field of Search ..... 173/134–138; 91/290, 300, 321

[56] References Cited

U.S. PATENT DOCUMENTS 4,230,019 10/1980 Castan ..... 91/321

4,646,854 3/1987 Arndt et al. ..... 173/134

*Primary Examiner*—Frank T. Yost

*Assistant Examiner*—James L. Wolfe

*Attorney, Agent, or Firm*—Cooper & Dunham

[57] ABSTRACT

An impact device that consists of a housing having a bore, a piston, and a change-over valve for control of the reciprocal movement of the piston is presented in the present invention. In the present invention, it is not necessary to employ a long-size piston and a high piston speed is obtained and, further, a compact device in which the fluctruation of the pressure in the low pressure path is small can be obtained.

5 Claims, 2 Drawing Sheets

IMPACT DEVICE

FIELD OF THE INVENTION

The present invention relates to an improved impact device. More particularly, the present invention relates to an improved impact device consisting of a housing having a bore, a piston, and a change-over valve for control of the reciprocal movement of the piston; the piston is reciprocable in the bore and consists of an upper shaft and a lower shaft, the diameter of said upper shaft is smaller than the diameter of said lower shaft and an upper flange part is formed in the middle part of said upper shaft of the piston and a lower flange part is formed at the upper end of said lower shaft, the diameter of said upper flange part is smaller than the diameter of said lower flange part and is substantially the same as the diameter of said lower shaft and, the upper surface of said upper flange part is a pressure effective surface for descending and the lower surface of said lower flange part is a pressure effective surface for ascending, the area of said lower surface of said lower flange part is larger than the area of said upper surface of said upper flange part, the bore consists of an upper bore in which said upper flange part is inserted and a lower bore in which said lower flange part is inserted, and said bore has an upper space formed on the upper side from said upper flange part of the piston, a middle space formed between said upper flange part and said lower flange part of said piston, and a lower space formed on the lower side from said lower flange part of said piston, wherein said piston is pressed to descent and said lower space of said bore which supplies the hydraulic pressure to said lower surface of said lower flange part of said piston for ascending is reciprocally connected to a high pressure path and a low pressure path by a change-over movement of a change-over valve driven by said hydraulic pressure corresponding with the position of said piston so that said piston is driven to descend and ascend reciprocally.

DESCRIPTION OF THE PRIOR ART

Hitherto, in an impact device, since a large quantity of oil is exhausted into the low pressure path from the bore of the housing in shich the piston is reciprocable, a backpressure is generated in the low pressure path so that the hammer speed, namely the striking force is decreased and a large fluctuation of pressure in said low pressure path makes the rubber hose of said low pressure path oscillate and so shorten the life of said rubber hose. To resolve the above described problem, an improvement has been presented by the inventor of the present invention (Japanese utility model application, publication No. 26935-1985). In this improvement, a stepped surface is formed by making the diameter of the upper part of the piston from the stepped surface reduced, the area of said stepped surface is substantially equal to the area of the surface on which the pressure effects to ascent the piston, and said stepped surface is inserted in the buffer chamber which is formed in the bore of the housing and connects to the low pressure path.

Nevertheless, said improved impact device still has a fault in the sizes of said piston and said housing become long since a stepped surface is formed in the upper part of said piston and therefore a buffer chamber is also formed in the uppper part of the bore of said housing and the impact device becomes large in size and heavy.

SUMMARY OF THE INVENTION

Accordingly, an object of the present invention is to present a further improved impact device having a compact structure and a small size. Another object of the present invention is to present a further improved impact device in which the fluctuation of the pressure in the low pressure path is small.

Briefly, said object of the present invention can be attained by a further improved impact device consisting of a housing having a bore, a piston, and a change-over valve for control of the reciprocal movement of the piston; the piston is reciprocable in the bore and consists of an upper shaft and a lower shaft, the diameter of said upper shaft is smaller than the diameter of said lower shaft and an upper flange part is formed in the middle part of said upper shaft of said piston and a lower flange part is formed at the upper end of said lower shaft, the diameter of said upper flange part is smaller thant the diameter of said lower flange part and substantially the same as the diameter of said lower shaft and, the upper surface of said upper flange part is a pressure effective surface for descending and the lower surface of said lower flange part is a pressure effective surface for ascending, the area of said lower surface of said lower flange part is larger than the area of said upper surface of said upper flange part, the bore consists of an upper bore in which said upper flange part is inserted and a lower bore in which said lower flange part is inserted, and said bore has an upper space formed in the upper side from said upper flange part of said piston, a middle space formed between said upper flange part and said lower flange part of said piston, and a lower space formed in the lower side from said lower flange part of said piston, wherein said piston is pressed to descend and the lower space of said bore which supplies the hydraulic pressure to said lower surface of said lower flange part of said piston for ascending is reciprocally connected to a high pressure path and a low pressure path by the change-over movement of a change-over valve driven by hydraulic pressure corresponding with the position of said piston so that said piston is driven to descend and ascend reciprocally.

BRIEF DESCRIPTION OF THE DRAWINGS

FIG. 1 is a side sectional view of the embodiment showing the situation immediately after the piston strikes the hammer.

FIG. 2 is a side sectional view of the embodiment showing the situation as the piston just starts to descend.

DETAILED DESCRIPTION

Figure 1:
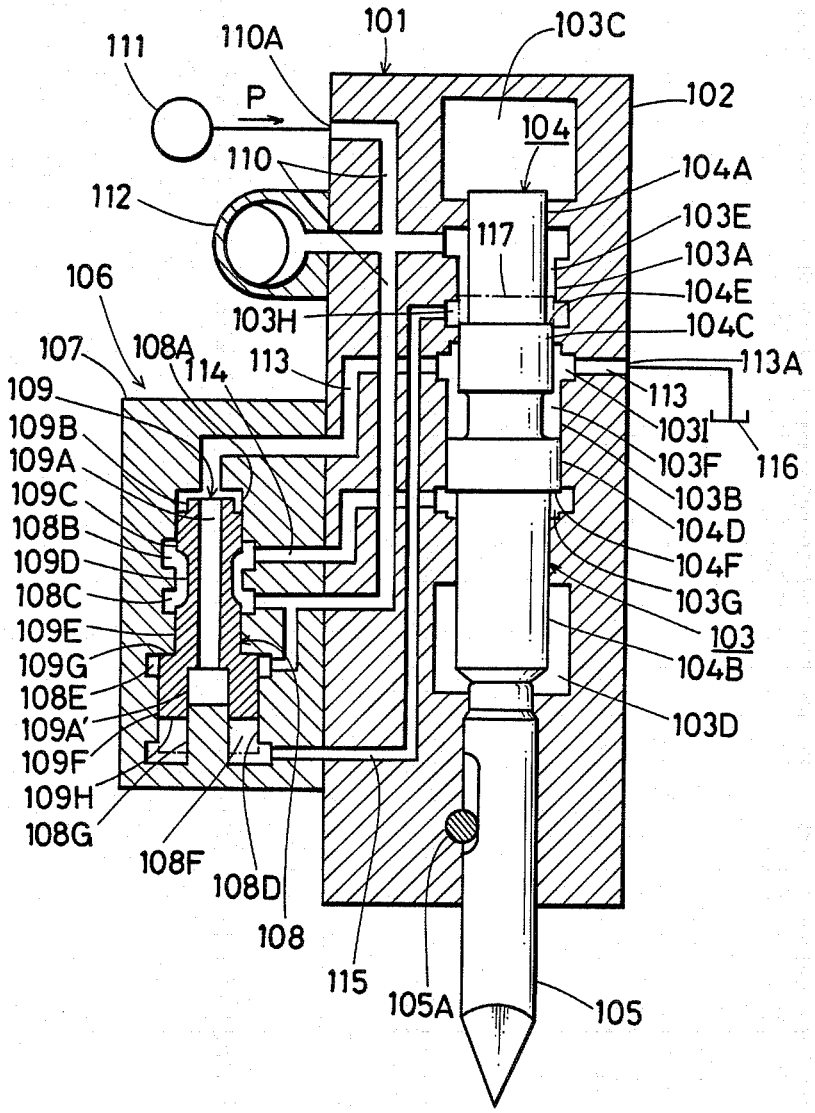
FIGS. 1 and 2 relate to an embodiment of the present invention.
Figure 2:
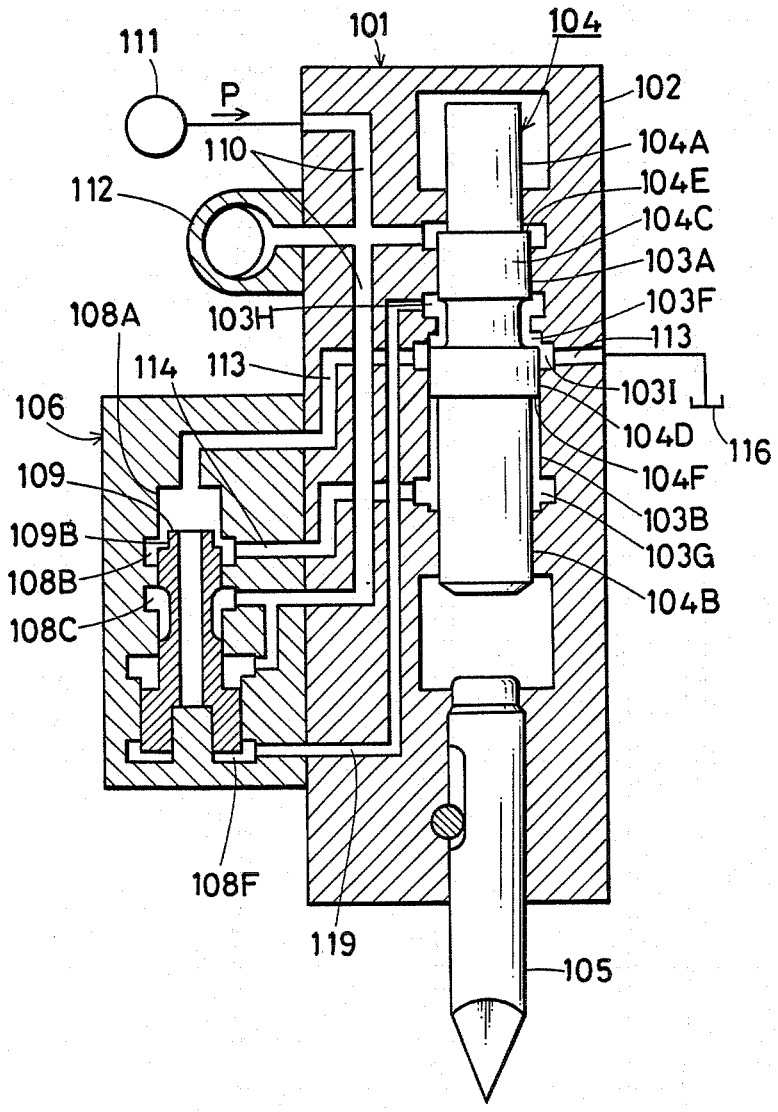

FIG. 1 and FIG. 2 relate to an embodiment of the present invention. Referring now to FIG. 1 and FIG. 2, an impact device (101) consists of a housing (102) having a bore (103), a piston (104) which is reciprocable in said bore (103), a hammer (105) which is able to slide in said bore (103) and prevented from coming out from said bore (103) by a pin (105A) and a change-over valve (106) for control of the reciprocal movement of said piston (104). Said piston (104) consists of an upper shaft (104A) and a lower shaft (104B) wherein the diameter of said upper shaft (104A) is smaller than the diameter of said lower shaft (104B) and an upper flange part (104C) is formed in the the middle part of said upper shaft (104A) and a lower flange part (104D) is formed at the upper end of said lower shaft (104B). The diameter of said upper flange part (104C) is smaller than the diameter of said lower flange part (104D) and substantially the same as the diameter of said lower shaft (104B) and the upper surface (104E) of said upper flange part (104C) is a hydraulic pressure effective surface for descending and the lower surface (104F) of said lower flange part (104D) is a hydraulic pressure effective surface for ascending wherein the area of said lower surface (104F) of said lower flange part (104D) is larger than the area of said upper surface (104E) of said upper flange part (104C).

The bore (103) of the housing (102) consists of an upper bore (103A) in which an upper flange part (104C) is inserted and a lower bore (103B) in which a lower flange part (104D) is inserted and an upper chamber (103C) is formed at the upper end of said bore (103) and a lower chamber (103D) is formed at the lower end of said bore (103).

Further, an upper space (103E), a middle space (103F), and a lower space (103G) are formed in said bore (103), and the volumes of said spaces (103E), (103F) and (103G) are respectively varied by the reciprocal movement of the piston (104) wherein said upper space (103E) is formed in the upper side from said upper flange part (104C) of said piston (104), said middle space (103F) is formed between said upper flange part (104C) and said lower flange part (104D) of said piston (104), and said lower space (103G) is formed in the lower side from said lower flange part (104D) of said piston (104). Further, a pilot ring cavity (103H) is formed in said upper bore (103A) of said bore (103) and a low pressure cavity (103I) is formed in said lower bore (103B) of said bore (103).

The upper end of said piston (14) goes in and out of said upper chamber (103C) and the lower end of said piston (104) goes in and out of said lower chamber (103D) according to the reciprocal movement of said piston (104) and, said upper chamber (103C) and said lower chamber (103D) are opened to the atmosphere respectively.

The change-over valve (106) for control of the reciprocal movement of the piston (104) is connected to the improved impact device (101). The change-over valve (106) consists of a housing (107) having a bore (108) and a two-step type spur (109) which is reciprocable in said bore (108). Said spur (109) has a center penetrating hole (109A) having a larger diameter part (109A') at the lower end and consists of an upper end part (109B) for the change-over of said piston's driving circuit, an upper part (109C), a ring indentation (109D) for the change-over of said piston's driving circuit, a middle part (109E), and a lower part (109F) wherein the diamter of said upper end part (109B) is smaller than the diameters of said upper part (109C) and said middle part (109E), and the diameter of said lower part (109F) is larger than the diameters of said upper part (109C) and said middle part (109E). Nevertheless, said upper end part (109B) may be omitted since said part (109B) does not affect the hydraulic flow. Further, the upper ring's surface (109G) of said lower part (109F) of said spur (109) around the lower end of said middle part (109E) is a smaller hydraulic pressure effective surface and the lower ring's surface (109H) of said lower part (109F) of said spur (109) around said larger diameter part (109A') of said hole (109A) is a larger hydraulic pressure effective surface, and the area of said lower ring's surface (109H) is larger than the area of said upper ring's surface (109G).

The bore (108) of the change-over valve (106) has an upper valve hole (108A) in which the upper part (109C) of the spur (109) is reciprocable, a ring cavity (108B) for the supplying and exhausting of the hydraulic pressure which is formed in said upper valve hole (108A), an entrance ring cavity (108C) also formed in said upper valve hole (108A), a lower valve hole (108D) in which the lower part (109F) of said spur (109) is reciprocable, a first valve chamber (108E) enclosed by said lower valve hole (108D) and an upper ring surface (109G) of said spur (109), and a second valve chamber (108F) enclosed by said lower valve hole (108D) and the lower ring's surface (109H). A pin (108G) is formed from the bottom of said lower valve hole (108D) and said pin (108G) is inserted into the larger diameter part (109A') of the hole (109A).

Further, a high-pressure path (110) for supplying high hydraulic pressure is formed in the housing (102) of the improved impact device (101) and the upper part of said high pressure path (110) connects to the upper space (103E) of the bore (103) and the lower part of said high pressure path (110) connects to said entrance ring cavity (108C) of said upper valve hole (108A) of said bore (108) and said first valve chamber (108E) of said bore (108), and the entrance (110A) connects to a hydraulic pressure souce (111) such as a hydraulic pressure pump which is installed outside said housing (102) of the improved impact device (101). Still further, an accumulator (112) is connected to said high pressure path (110). Still further, a low pressure path (113) for returning said hydraulic pressure, a supplying and exhausting path (114), and a pilot path (115) are formed in said housing (102) of the impact device (101). Said low pressure path (113) connects to the low pressure cavity (103I) of the lower bore (103B) of said bore (103) and said upper valve hole (108A) of said bore (108) of said change-over valve (106) and the exit (113A) of said low pressure path (113) connects to a tank (116). The supplying and exhausting path (114) connects to the lower space (103G) of said bore (103) of said housing (102) and said ring cavity (108B) of said upper valve hole (108A) of said bore (108) of said change-over valve (106). The pilot path (115) connects to the pilot ring cavity (103H) of the upper bore (103A) of said bore (103) and the second valve chamber (108F) of the lower valve hole (108D) of said bore (108) of said change-over valve (106). The above described housing (102) and (107) are dividable and therefore the piston (104) and the spur (109) can be inserted into bores (103) and (108).

The movement of the impact device will be explained as follows. FIG. 1 shows a situation immediatly after the piston (104) strikes the manner (105). In this situation, the hydraulic pressure P from the hydraulic pressure soure (111) effects onto the lower ring's surface (109H) of the lower part (109F) of the spur (109) through the pilot path (115) since the upper space (103E) of the bore (103) connecting to the high pressure path (110) and the pilot ring cavity (103H) of the upper bore (103A) of said bore (103) are connected respectively, and said spur (109) slides to the first valve chamber's (108E) side, namely the upper side, from the position shown by the dotted line (117). In this case, said hydraulic pressure P also has effect on the upper ring's surface (109G). Nevertheless, as above described, said spur (109) slides to the upper side since the area of said lower ring's surface (109H) is larger than the area of said upper ring's surface (109G) as before described. Since the ring's indentation (109D) connects between the ring cavity (108B) and the entrance ring cavity (108C) by said sliding of said spur (109), said hydraulic pressure P has effect on the lower surface (104F) of the flange part (104D) of said piston (104) through the supplying and exhausting path (114) and said piston (104) ascends since the area of said lower surface (104F) of said flange part (104D) of said piston (104) is larger than the upper surface (104E) of said flange part (104D) of said piston (104).

According to the ascent of said piston (104), the oil in the middle space (103F) of said bore (103) flows into the low pressure path (113) and returns to the tank (116) through the exit (113A), and in this case, the flow speed of said oil which is exhausted into said tank (116) is small and the fluctuation of the hydraulic pressure is thus prevented from becoming high since it is not necessary to make the ascending speed of said piston (104) as high as the descending speed. After said pilot ring cavity (103H) is closed by the ascent of said piston (104) as shown by the dotted line (117), when said piston (104) reaches substantially the upper dead point as shown in FIG. 2, said pilot ring cavity (103H) connects to said middle space (103F), and said pilot path (115) connects to the low pressure cavity (103I) and said low pressure path (113). In this situation, said hydraulic pressure in the second valve chamber (108F) rapidly decreases and said spur (109) slides to said second valve's chamber (108F) side (lower side) by said hydraulic pressure having an effect on said upper ring's surface (109G) of said lower part (109F) of said spur (109) as shown in FIG. 2. Thus, the connection between said ring cavity (108B) of said bore (108) and the entrance ring cavity (108C) of said bore (108) is intercepted by the descent of said spur (109) and said ring's cavity (108B) connects to said low pressure path (113) through the space between the upper end part (109D) of said spur (109) and the upper valve hole (108A). When said ring cavity (108B) connects to said low pressure path (113) as above described, the hydraulic pressure in the supplying and exhausting path (114) and the lower space (103G) of said bore (103) becomes low and therefore said piston (104) decends by said hydraulic pressure P having effect on said upper surface (104E) of the flange part (104C) of said piston (104). According to said descent of said piston (104), the oil flowing out from said lower space (103G) of said bore (103) flows almost into said middle space (103F) of said bore (103) which increases its volume by said descent of said piston (104) through said low pressure path (113) and a little amount of the oil returns to said tank (116). Therefore, said piston (104) rapidly descends since the backpressure in said lower space (103G) is low and accordingly resistance against said piston (104) is small.

When the piston (104) reaches the position shown in FIG. 1 to strike the hammer (105), the pilot ring cavity (103H) connects to the high pressure path (110) through the upper space (103E) of the bore (103), and the hydraulic pressure P has effect on the lower ring's surface (109H) of the lower part (109F) of the spur (109) to let said spur (109) of the change-over valve (106) slide to the first valve chamber's (108) side (upper side) and the above described movement is repeated.

Further, in said above described movement of the improved impact device, the dropping of the hydraulic pressure in said upper space (103E) of said bore (103) is small since the hydraulic pressure accumulated in the accumulator (112) during the ascent of said piston (104) is exhausted into said high pressure path (110) during said descent of said piston (104), and further, since the backpressure of said upper space (103E) is low as above described, said piston (104) will decend with a much higher speed to give said hammer (105) a great impact force.

In this embodiment, the piston is descended by hydraulic pressure using oil, nevertheless, in the impact device of the present invention, the descending movement of said piston and the change-over movement of the change-over valve will be carried out by the resilient force of a spring, a compressed gas and the like, or by using both hydraulic pressure and said resilient force. Further, the spur of said change-over valve may not always be as the above described two-step type but be of a bobbin type.

As above described, in the present invention, since the upper part of the lower bore of the bore of the housing is employed as the middle space to store the out flowing oil and the oil exhausted from the lower space of said bore into the low pressure path during descent of the piston almost all flows into said middle space, it is not necessary to employ a long-size piston and a long-size hammer and, a high piston speed is obtained and, further, a compact device in which the fluctuation of pressure in said low pressure path is small can be obtained.

I claim:

1. An impact device that consists of a housing having a bore, a piston, and a change-over valve for control of the reciprocal movement of the piston; the piston is reciprocable in the bore and consists of an upper shaft and a lower shaft, the diameter of said upper shaft is smaller than the diameter of said lower shaft and an upper flange part is formed in a middle part of said upper shaft of said piston and a lower flange part is formed at an upper end of said lower shaft, the diameter of said upper flange part is smaller than the diameter of said lower flange part and substantially the same as the diameter of said lower shaft and an upper surface of said upper flange part is a pressure effective surface for descending and a lower surface of said lower flange part is a pressure effective surface for ascending, the area of said lower surface of said lower flange part is larger than the area of said upper surface of said upper flange part, the bore consists of an upper bore in which said upper flange part is inserted and a lower bore in which said lower flange part is inserted, and said bore has an upper space formed in an upper side from said upper flange part of said piston, a middle space formed between said upper flange part and said lower flange part of said piston, and a lowre space formed in the lower side from said lower flange part of said piston, wherein said piston is pressed to descend and the lower space of said bore which supplies the hydraulic pressure to said lower surface of said lower flange part of said piston for ascending is reciprocally connected to a high pressure path and a low pressure path by the change-over movement of a change-over valve driven by hydraulic pressure corresponding with the position of said piston so that said piston is driven to descend and ascend reciprocally.

2. An impact device of claim 1, wherein the piston is pressed to descend by hydraulic pressure.

3. An impact device of claim 1, wherein the piston is pressed to descend by a resilient force.

4. An impact device of claim 1, wherein the piston is of a two-step type.

5. An impact device of claim 1, wherein the piston is of a bobbin type.

* * * * *